United States Patent [19]

Lazaroff

[11] 4,231,239

[45] Nov. 4, 1980

[54] SPRAY WASHER SYSTEM

[76] Inventor: Gary G. Lazaroff, 144 Gunston Hall Ct., Chesterfield, Mo. 63017

[21] Appl. No.: 30,451

[22] Filed: Apr. 16, 1979

[51] Int. Cl.[3] ..... D06F 35/00

[52] U.S. Cl. ..... 68/205 R; 118/316; 118/323; 134/181; 134/199; 239/178; 239/243; 239/556

[58] Field of Search ..... 68/205 R; 134/180, 181, 134/199; 118/316, 323; 239/178, 184, 243, 556, 557

[56] References Cited

U.S. PATENT DOCUMENTS

| | | | |
|---|---|---|---|
| 2,552,871 | 5/1951 | Shaw | 239/243 X |
| 2,822,635 | 2/1958 | Mears | 118/316 X |
| 3,674,211 | 7/1972 | Gage et al. | 134/199 X |
| 3,688,530 | 9/1972 | Harris et al. | 68/205 R |
| 3,827,262 | 8/1974 | Manuel | 68/205 R X |

*Primary Examiner*—Philip R. Coe
*Attorney, Agent, or Firm*—Cohn, Powell & Hind

[57] ABSTRACT

A spray washing system for garments including aspray station through which garments are transported in a generally vertical plane. The spray station has a set of vertically spaced pipes with parallel axes extending generally parallel to said plane. Each of the pipes forms an acute angle with the horizontal. A spray nozzle is mounted on each of the pipes and is arranged to direct a spray against garments in said plane. The pipes are rotatively oscillated about their axes to cause the spray area of the nozzles mounted thereon to oscillate. The vertically spaced pipes are interconnected so as to be simultaneously rotatively oscillated. Bars are rigidly connected to and extend from the pipes. Links are rotatively connected to the bars of two vertically spaced pipes on rotative axes parallel to the pipe axes, and provide for simultaneous movement of the interconnected bars. An arm is rotatively connected to a bar on one of the pipes on a rotative axis parallel to the axis of said one pipe for oscillating the pipes. A motor rotatively drives a drive wheel to which the arm is operatively connected. A connecting rod is rotatively connected to the drive wheel on one end and to a pivotally mounted lifter on the other end. The arm is connected to the lifter, and lifter is pivotally oscillated to actuate the arm for oscillating the pipes.

5 Claims, 3 Drawing Figures

SPRAY WASHER SYSTEM

BACKGROUND OF THE INVENTION

This invention relates generally to a spray washing system for garments, and for particularly to a system for rotatively oscillating pipes carrying nozzles in a spray station of a spray washing system.

The mounting of pipes in a spray station so as to form an acute angle with the horizontal is known. U.S. Pat. No. 3,827,262 discloses the advantages of rotatively oscillating such nozzle-carrying pipes. Because spray washing systems are in continuous use it is important that the means for rotatively oscillating the pipes be both reliable and easy to maintain.

SUMMARY OF THE INVENTION:

The spray washing system for garments includes a means for rotatively oscillating the pipes which is both reliable and easy to maintain.

The spray washing system includes a spray station through which garments are transported in a generally vertical plane. The spray wash station has a set of vertically spaced pipes with parallel axes extending generally parallel to the plane. Each of the pipes forms an acute angle with the horizontal. A spray nozzle is mounted on each of the pipes and is arranged to direct a spray against garments in the plane. Means are provided for rotatively oscillating the pipes about their axes to cause the spray area of the nozzles mounted on the pipes to oscillate.

The vertically spaced pipes are interconnected to provide for simultaneous rotative oscillation of the pipes. The interconnecting means includes bars which are rigidly connected to and extend from the pipes, and links which are rotatively connected to the bars of two vertically spaced pipes to provide for simultaneous movement of the interconnected bars. Each link is rotatively connected to the bars on rotative axes that are parallel to the axes of the pipes.

The means for rotatively oscillating the pipes comprises an arm which is rotatively connected to a bar on one of the pipes. The arm is rotatively connected to the bar on a rotative axis that is parallel to the axis of said one pipe. A motor means rotatively drives a drive wheel to which the arm is operatively connected to actuate the arm for oscillating the pipes.

In one aspect of the invention, a base is mounted on the spray station, the base carrying the motor means and drive wheel. A connecting rod has one of its ends rotatively connected to the drive wheel. A lifter is pivotally mounted to the base and is rotatively connected to the opposite end of the connecting rod. The arm is also rotatively connected to the lifter in a manner such that the arm is oscillated when the lifter is pivotally oscillated.

In another aspect of the invention, the base is adjustably mounted to the spray station with the plane of the base parallel to the axes of the pipes. The drive wheel, connecting rod and lifter are on rotative axes parallel to the plane of the base.

In another aspect of the invention, two bars are attached to one pipe. The arm is connected to one of the bars while a link is connected to the other of the bars. A bar is attached to a vertically adjacent pipe and the aforesaid link is attached to this bar. In one aspect, the bars to which the aforesaid link is attached on the adjacent vertically spaced pipes, are in paralled relationship. The link provides for parallel movement of the bars.

The spray station has opposed side end walls which include vertically spaced holes, the ends of the vertically spaced pipes extending through the holes. Brackets are attached to the end walls adjacent to the holes, and have portions inclined perpendicularly to the axes of the pipes. The brackets receive the pipes extending through the holes for supporting the pipes.

The spray station includes a second set of nozzle-carrying, rotatively oscillating pipes mounted on the opposite side of the vertical plane. The second set of pipes includes links and bars connected to a second arm and a second lifter. A second connecting rod is rotatively connected to the drive wheel at the same eccentric point as that of the connecting rod which drives the first set of oscillating pipes. This drive assembly oscillates the pipes of the two sets out of phase such that when the pipes of one set are rotating in one direction the pipes of the other set are rotating in the relatively opposite direction. In one aspect, the two sets of pipes rotate one hundred eighty (180) degrees out of phase.

DESCRIPTION OF THE PREFERRED EMBODIMENT

Figure 1:
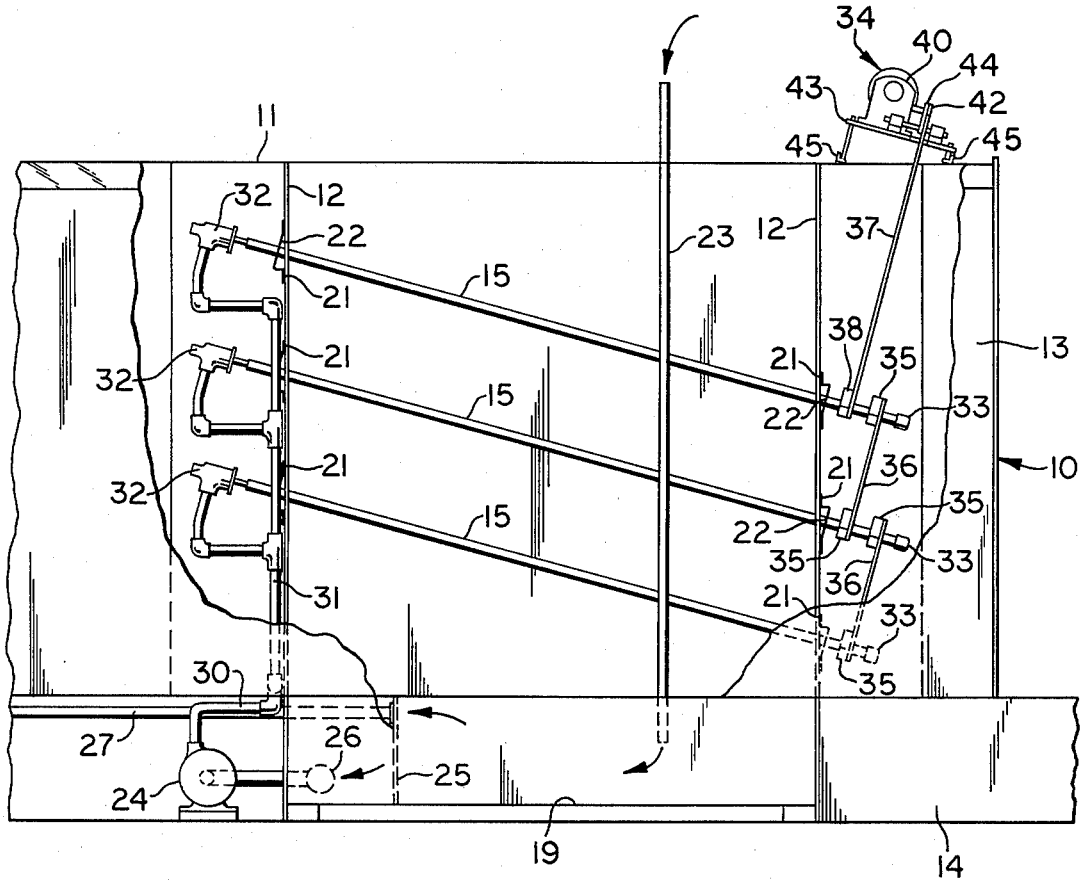
FIG. 1 is a cut-away front elevational view of the spray station.
Figure 2:
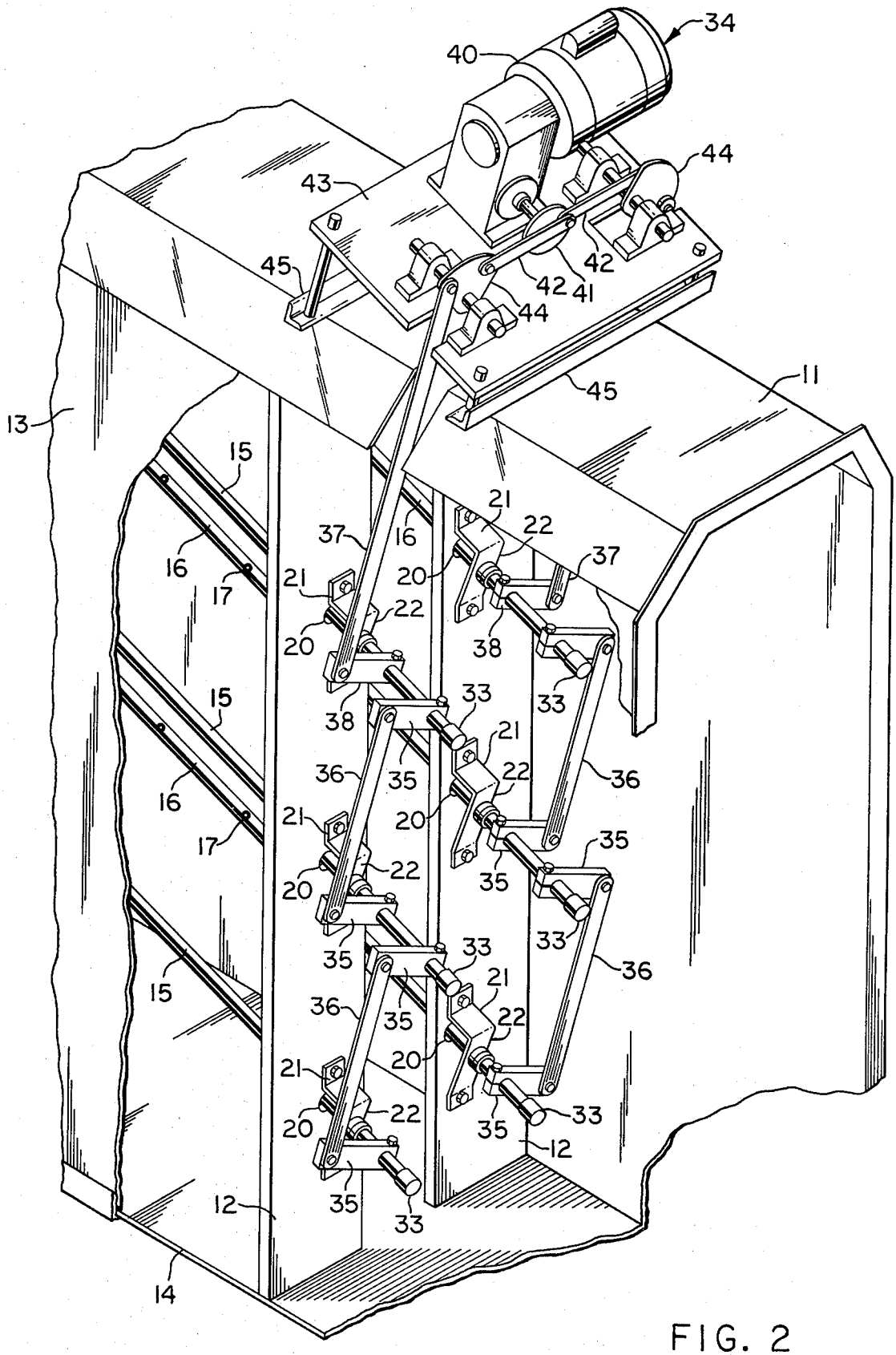
FIG. 2 is a perspective view of the oscillating means on one end of the spray station.
Figure 3:
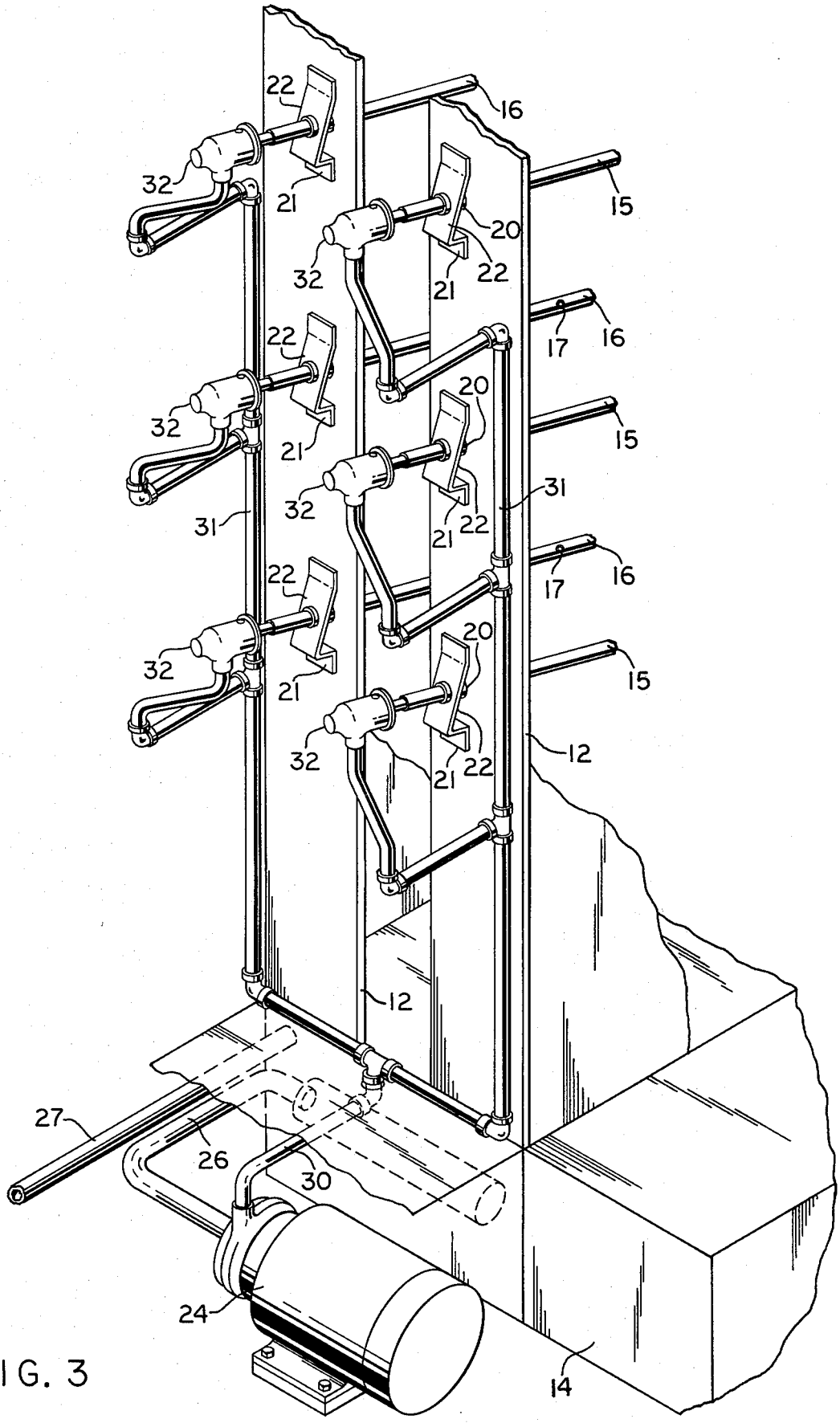
FIG. 3 is a perspective view of the opposite end of the spray station.

Referring now by characters of reference to the drawings, and first to FIG. 1, the spray washing system for garments includes a spray station indicated generally by 10. The spray station 10 includes a top wall 11, end walls 12, side walls 13 and a base 14. The spray station 10 includes two sets of vertically spaced pipes 15 and 16 respectively. The axes of the pipes 15 and 16 are parallel, while each of the pipes 15 and 16 forms an acute angle with the horizontal. The planes of the two sets of pipes 15 and 16 are parallel each of the pipes 15 being horizontally spaced from a corresponding pipe 16. As can be most clearly seen in FIGS. 2 and 3, a vertical plane exists between the two sets of pipes 15 and 16 in which garments (not shown) are transported.

Mounted on each of the pipes 15 and 16 are a plurality of nozzles 17. The nozzles 17 are arranged to direct a spray of liquid against garments in the vertical plane. The nozzles 17 mounted on horizontally spaced pipes 15 and 16 are directly opposite each other.

The pipes 15 and 16 extend through vertically spaced holes 20 in the end walls 12. Brackets 21 are attached to the end walls 12 adjacent to the holes 20. The brackets 21 have portions 22 inclined perpendicularly to the axes of the pipes 15 and 16. The pipes 15 and 16 extending through the holes 20, are received and supported by the bracket portions 22.

The base 14 includes a tank 19. Make-up liquid is introduced into the tank 19 through an intake line 23. A pump 24 draws liquid from the tank 19, through filter screen 25 and pump inlet 26. An overflow line 27 draws off excess liquid from the tank 19. The pump 24 has its outlet connected by pipes 30 to headers 31. One header 31 is connected to each of the sets of pipes 15 and 16. Rotative couplers 32 are used to connect the headers 31 to one end of each of the pipes 15 and 16. The opposite ends of the pipes 15 and 16 are closed by caps 33.

Means, indicated generally by 34, for rotatively oscillating the pipes 15 and 16, are provided. The oscillating means 34 includes means for interconnecting each set of the vertically spaced pipes 15 and 16. The interconnecting means includes bars 35 which are rigidly connected to and extend from the pipes 15 and 16. Links 36 are rotatively connected to bars 35 on vertically spaced pipes 15 and 16 on rotative axes parallel to the pipe axes. The links 36 provide for simultaneous movement of the interconnected bars 35. The links 36 are each mounted in a plane which is perpendicular to the axes of the pipes 15 and 16. The bars 35 which are interconnected by a link 36, are parallel. The links 36 provide for parallel movement of the interconnected bars 35.

Each set of vertically spaced pipes 15 and 16 has one pipe which is connected to an arm 37 by a bar 38. The arms 37 are rotatively connected to the bars 38 on rotative axes that are parallel to the axes of said one pipes. The arms 37 are oscillated in planes which are perpendicular to the axes of the pipes 15 and 16 to oscillate the interconnected pipes 15 and 16.

A motor means comprises a motor 40. The motor 40 rotatively drives a drive wheel 41. Connecting rods 42 are rotatively connected to the drive wheel 41 at an eccentric point on the drive wheel 41. The motor 40 is mounted on a base 43. Two lifters 44 are pivotally mounted on the base 43. One of the arms 37 is rotatively connected to one of the lifters 44, and the other arm 37 is rotatively connected to the other lifter 44. One of the connecting rods 42 is rotatively connected to one of the lifters 44, and the other rod 42 is rotatively connected to the other lifter 44 so as to pivotally oscillate the lifters 44 when the drive wheel 41 is rotated. The lifters 44 thereby cause the arms 37 to oscillate, which oscillates the interconnected bars 35 and 38, and the pipes 15 and 16.

Adjustable mounting brackets 45 attach the base 43 to the top wall 11 of the spray station 10. The adjustable brackets 45 ae adjusted so that the plane of the base 43 is parallel to the axes of the pipes 15 and 16. The lifters 44, connecting rods 42 and drive wheel 41 are mounted on rotative axes parallel to the plane of the base 43.

The connection of the connecting rods 42 to the same eccentric point on the drive wheel 41 provides for out-of-phase oscillation of the opposed sets of pipes 15 and 16. When the pipes 15 are rotating in one direction, the pipes 16 are rotating in the opposite direction.

It is thought that the structural features and functional advantages of this device have become fully apparent from the foregoing description of parts, but for completeness of disclosure the operation of the device will be briefly discussed.

Make-up liquid is introduced into the spray station 10 through pipe 23 into tank 19. Excess liquid from the tank 19 is drained off through the pipe 27. Pump 24 pumps liquid from the tank 19 through the pipes 30 to the headers 31. The liquid is pumped through the rotative couplers 32 into the pipes 15 and 16. The liquid sprays out of the nozzles 17 which are mounted on the pipes 15 and 16 to spray garments in the plane between the sets of pipes 15 and 16. The sprayed liquid is collected in the tank 19 to be re-pumped through the system or overflow out the overflow pipe 27.

The pipes 15 and 16 are oscillated to oscillate the spray area of the nozzles 17 on the garments. The motor 40 turns the drive wheel 41, while the connecting rods 42 pivotally oscillate the lifters 44. The arms 37 are oscillated by the lifters 44. Because of the connection of the connecting rods 42 to the drive wheel 41 and the lifters 44, it is apparent that as the arm 37 which is connected to one of the pipes 15, is moving in a generally upward direction, the arm 37 which is connected to one of the pipes 16, is moving in a generally downward direction, and vice versa.

The arms 37 are connected to the bars 38 which are rigidly connected to the pipes 15 and 16. The generally up-and-down oscillation of the arms 37 move the bars 38 causing the pipes 15 and 16 to rotatively oscillate. Bars 35 are attached to the pipes to which the bars 38 are connected. Links 36 connected to the bars 35 are oscillated by the turning of the pipes 15 and 16. The links 36 are connected to bars 35 attached to adjacent vertically spaced pipes 15 and 16. The vertically spaced pipes 15 and 16 are thereby rotatively oscillated. Additional vertically spaced pipes 15 and 16 are connected in a similar manner by bars 35 and links 36. The last set of vertically spaced pipes 15 and 16 each has only the one bar 35 attached. Horizontally spaced pipes 15 and 16 oscillate out-of-phase because of the connection of the connecting rods 42 to the drive wheel 41 and lifters 44, to provide washing and rinsing action from the liquid spray of the nozzles 17.

In the preferred embodiment, the horizontally spaced pipes 15 and 16 oscillate one hudred eighty (180) degrees out of phase, to prevent garments from being lifted by the liquid spray of the nozzles 17.

I claim as my invention:

1. In a spray washing system for garments including a spray station through which garments are transported in a generally vertical plane, the spray station having a set of vertically spaced pipes with parallel axis extending generally parallel to said plane, each of said pipes forming an acute angle with the horizontal, a spray nozzle mounted on each of said pipes and arranged to direct a spray against garments in said plane, and means for rotatively oscillating the pipes about their axes to cause the spray area of the nozzles mounted thereon to oscillate, wherein the improvement comprises:

(a) the means for rotatively oscillating said pipes comprising means for interconnecting the vertically spaced pipes for simultaneously rotatively oscillating the vertically spaced pipes, the interconnecting means including:
   1. bars rigidly connected to and extending from the pipes, and
   2. links rotatively connected to the bars of two vertically spaced pipes on rotative axes parallel to the pipe axes for providing simultaneous movement of the interconnected bars, (b) the means for rotatively oscillating the pipes further comprising an arm rotatively connected to a bar on one of said pipes on a rotative axis parallel to the axis of said one pipe for oscillating said pipes, (c) the means for rotatively oscillating the pipes further comprising:
   1. a motor means,
   2. a drive wheel rotatively driven by the motor means,
   3. the arm being operatively connected to the drive wheel for oscillating the arm,
   4. a base mounted on the spray station, the base carrying the motor means and drive wheel,
   5. a connecting rod having one end rotatively connected to the drive wheel, and 6. a lifter pivotally mounted to the base, the other end of the connecting rod being rotatively connected to the lifter, and the arm being rotatively connected to the lifter, the lifter being pivotally oscillated by the rod to oscillate the arm, (d) the base is adjustably mounted to the spray station, the plane of the base being parallel to the axes of the pipes, and being at an acute angle with the horizontal, and (e) the drive wheel connecting rod and lifter are mounted on rotative axes parallel to the plane of the base.

2. In a spray washing system for garments including a spray station through which garments are transported in a generally vertical plane, the spray station having a set of vertically spaced pipes with parallel axis extending generally parallel to said plane, each of said pipes forming an acute angle with the horizontal, a spray nozzle mounted on each of said pipes and arranged to direct a spray against garments in said plane, and means for rotatively oscillating the pipes about their axes to cause the spray area of the nozzles mounted thereon to oscillate, wherein the improvement comprises:

(a) the means for rotatively oscillating said pipes comprising means for interconnecting the vertically spaced pipes for simultaneously rotatively oscillating the vertically spaced pipes, the interconnecting means including:

1. bars rigidly connected to and extending from the pipes, and 2. links rotatively connected to the bars of two vertically spaced pipes on rotative axes parallel to the pipe axes for providing simultaneous movement of the interconnected bars, (b) the means for rotatively oscillating the pipes further comprising an arm rotatively connected to a bar on one of said pipes on a rotative axis parallel to the axis of said one pipe for oscillating said pipes, (c) two bars are attached to said one pipe, the arm being connected to one of said bars, and a link being connected to the other of said bars, (d) another bar is attached to a pipe vertically adjacent to said one pipe, said link being attached to the last said bar, and (e) the bars to which said link is attached on said adjacent vertically spaced pipes are in parallel relationship, said link being in a plane which is perpendicular to the axes of said pipes and providing for parallel movement of said bars.

3. In a spray washing system for garments including a spray station through which garments are transported in a generally vertical plane, the spray station having a set of vertically spaced pipes with parallel axis extending generally parallel to said plane, each of said pipes forming an acute angle with the horizontal, a spray nozzle mounted on each of said pipes and arranged to direct a spray against garments in said plane, and means for rotatively oscillating the pipes about their axes to cause the spray area of the nozzles mounted thereon to oscillate, wherein the improvement comprises:

(a) the means for rotatively oscillating said pipes comprising means for interconnecting the vertically spaced pipes for simultaneously rotatively oscillating the vertically spaced pipes, the interconnecting means including:

1. bars rigidly connected to and extending from the pipes, and 2. links rotatively connected to the bars of two vertically spaced pipes on rotative axes parallel to the pipe axes for providing simultaneous movement of the interconnected bars, (b) the means for rotatively oscillating the pipes further comprising an arm rotatively connected to a bar on one of said pipes on a rotative axis parallel to the axis of said one pipe for oscillating said pipes, (c) the spray station has opposed side end walls each including vertically spaced holes, (d) the vertically spaced pipes extend through said holes in each end wall, and (e) brackets are attached to the end walls adjacent to said holes, the bracket having portions inclined perpendicular to the axes of the pipes, the bracket portions receiving said pipes extending through said holes for supporting the pipes.

4. In a spray washing system for garments including a spray station through which garments are transported in a generally vertical plane, the spray station having a set of vertically spaced pipes with parallel axis extending generally parallel to said plane, each of said pipes forming an acute angle with the horizontal, a spray nozzle mounted on each of said pipes and arranged to direct a spray against garments in said plane, and means for rotatively oscillating the pipes about their axes to cause the spray area of the nozzles mounted thereon to oscillate, wherein the improvement comprises:

(a) the means for rotatively oscillating said pipes comprising means for interconnecting the vertically spaced pipes for simultaneously rotatively oscillating the vertically spaced pipes, the inteconnecting means including:

1. bars rigidly connected to and extending from the pipes, and 2. links rotatively connected to the bars of two vertically spaced pipes on rotative axes parallel to the pipe axes for providing simultaneous movement of the interconnected bars, (b) the means for rotatively oscillating the pipes further comprising an arm rotatively connected to a bar on one of said pipes on a rotative axis parallel to the axis of said one pipe for oscillating said pipes, (c) the spray station including a second set of nozzle-carrying rotatively oscillating pipes mounted on the opposite side of said vertical plane, each pipe being at acute angle with the horizontal, (d) means for interconnecting the vertically spaced pipes of the second set including:

1. bars rigidly connected to and extending from the pipes, and 2. links rotatively connected to the bars of two vertically spaced pipes on rotative axes parallel to the pipe axes for simultaneous movement of the interconnected bars, (e) an arm is rotatively connected to a bar on one of said pipes of the second set on a rotative axis parallel to the axis of said one pipe for oscillating the pipes of said second set, and (f) the means for rotatively oscillating the pipes further comprising:

1. a motor means, 2. a drive wheel driven by the motor means, 3. two connecting rods rotatively connected to the drive wheel at the same eccentric point, and 4. two lifters, one lifter being connected to one rod and one arm, and the other lifter being connected to the other rod and the other arm for oscillating the pipes of the two sets out-of-phase such when the pipes of one set are rotating in one direction the pipes of the other set are rotating in the relatively opposite direction.

5. In a spray washing system for garments including a spray station through which garments are transported in a generally vertical plane, the spray station having a set of vertically spaced pipes with parallel axis extending generally parallel to said plane, each of said pipes forming an acute angle with the horizontal, a spray nozzle mounted on each of said pipes and arranged to direct a spray against garments in said plane, and means for rotatively oscillating the pipes about their axes to cause the spray area of the nozzles mounted thereon to oscillate wherein the improvement comprises:

(a) the means for rotatively oscillating said pipes comprising means for interconnecting the vertically spaced pipes for simultaneously rotatively oscillating the vertically spaced pipes, the interconnecting means including:
   1. bars rigidly connected to and extending from the pipes, and
   2. links rotatively connected to the bars of two vertically spaced pipes on rotative axes parallel to the pipe axes for providing simultaneous movement of the interconnected bars, (b) the means for rotatively oscillating the pipes further comprising an arm rotatively connected to a bar on one of said pipes on a rotative axis parallel to the axis of said one pipe for oscillating said pipes, (c) the spray station including a second set of nozzle-carrying rotatively oscillating pipes mounted on the opposite side of said vertical plane, each pipe being at an acute angle with the horizontal, (d) means for interconnecting the vertically spaced pipes of the second set including:
   1. bars rigidly connected to and extending from the pipes, and
   2. links rotatively connected to the bars of two vertically spaced pipes on rotative axes parallel to the pipe axes for simultaneous movement of the interconnected bars, (e) an arm is rotatively connected to a bar on one of said pipes of the second set on a rotative axis parallel to the axis of said one pipe for oscillating the pipes of said second set, and (f) the means for rotatively oscillating the pipes further includes means for oscillating the two sets of pipes one hundred eighty (180) degrees out-of-phase.

* * * * *